US009402517B2

(12) United States Patent
Van Den Bosch et al.

(10) Patent No.: US 9,402,517 B2
(45) Date of Patent: Aug. 2, 2016

(54) EXHAUST GRILLE

(71) Applicant: Koninklijke Philips N.V., Eindhoven (NL)

(72) Inventors: Michael Van Den Bosch, Eindhoven (NL); David Schippers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/376,488

(22) PCT Filed: Sep. 18, 2013

(86) PCT No.: PCT/EP2013/069320

§ 371 (c)(1),
(2) Date: Aug. 4, 2014

(87) PCT Pub. No.: WO2014/056686

PCT Pub. Date: Apr. 17, 2014

(65) Prior Publication Data

US 2015/0230675 A1 Aug. 20, 2015

(30) Foreign Application Priority Data

Oct. 9, 2012 (EP) ..... 12187745

(51) Int. Cl.
*A47L 5/00* (2006.01)
*A47L 9/00* (2006.01)

(52) U.S. Cl.
CPC ..... *A47L 9/0081* (2013.01)

(58) Field of Classification Search
CPC ..... A47L 9/0081
USPC ..... 15/326
IPC ..... A47L 5/00
See application file for complete search history.

(56) References Cited

U.S. PATENT DOCUMENTS

| | | | |
|---|---|---|---|
| 4,970,753 | A | 11/1990 | Herron, Jr. |
| 5,289,612 | A | 3/1994 | Glenn, III |
| 5,365,633 | A | 11/1994 | Sunagawa |
| 7,225,504 | B2 | 6/2007 | Ni |
| 7,337,876 | B2 | 3/2008 | Larsen |
| 7,882,592 | B2 | 2/2011 | Hwang |
| 2004/0026167 | A1 | 2/2004 | Larsen |
| 2004/0205926 | A1 | 10/2004 | Fawcett |
| 2009/0130970 | A1 | 5/2009 | Jacak |

FOREIGN PATENT DOCUMENTS

| | | | |
|---|---|---|---|
| DE | 4315712 | A1 | 11/1994 |
| DE | 102010039483 | A1 | 2/2012 |
| JP | 5873414 | A | 10/1981 |
| JP | 6245631 | Y2 | 12/1987 |
| JP | 3111015 | A | 5/1991 |
| JP | 2009045317 | A | 3/2009 |
| WO | 2004004535 | A1 | 1/2004 |

*Primary Examiner* — David Redding

(57) ABSTRACT

The present invention relates to an exhaust grille (10, 20, 30, 40). The exhaust grille comprises an array comprising an array of spaced vanes (15) which define a plurality of separate non-linear air flow passages (14) through the grille. The grill is configured so as to deflect sound waves incident upon the grille to prevent them from passing through the passages. Various configurations of exhaust grille are disclosed, and the exhaust grille configuration reduces the noise levels permitted to pass through the grille, for example when placed over an exhaust (2), such as over the exhaust outlet of a vacuum cleaner.

11 Claims, 4 Drawing Sheets

EXHAUST GRILLE

This application is the U.S. National Phase application under 35 U.S.C. §371 of International Application No. PCT/EP2013/069320, filed on Sep. 18, 2013, which claims the benefit of European Application No. 12187745.0 filed on Oct. 9, 2012. These applications are hereby incorporated by reference herein.

FIELD OF THE INVENTION

The present invention relates to an exhaust grille. The invention also relates to an appliance, such as a vacuum cleaner, incorporating the exhaust grille of the invention.

BACKGROUND OF THE INVENTION

A common type of vacuum cleaner generally comprises a motor that drives a fan to generate an air flow, and a collection vessel. In use, the collection vessel removes dirt and debris from the flow of air and the air is then expelled out to the atmosphere through an exhaust port.

Vacuum cleaners generally produce a lot of noise from the air flow and the motor. In most cases, the noise is mainly radiated by the nozzle and the housing of the vacuum cleaner. One of the paths for the noise to get out of the housing is via the exhaust channel. Due to the acoustically "hard" walls of the exhaust channel, a large part of the noise energy is reflected out of the canister, resulting in a high noise level of the total vacuum cleaner.

Counter measures are known to reduce the noise output, but many increase the flow resistance and/or take up a lot of space within the housing. It is known to provide acoustical absorption material inside the motor housing/compartment, and/or in the exhaust channel to reduce the noise.

It is known from U.S. Pat. No. 5,289,612 to reduce the noise of the fan and motor that the user is subjected to by utilising a muffler. The muffler is positioned over the end of an exhaust port, and is formed from a series of baffles that are configured to decrease the energy, and therefore, the noise, of the exhaust air. It has been found that using a muffler to decrease the energy of the exhaust air to reduce the noise emanating from the exhaust may also reduce the suction pressure produced by the fan, and, therefore, reduce the efficiency of the vacuum cleaner and its ability to clean.

DE102010039483 discloses a device for sound attenuation in air currents, in which a length of an edge of a sound-damping element is enlarged by means of alternating projections and recesses, so that a speed of an air flow on the edge is substantially reduced, whereby turbulence of the air flow is reduced, thus reducing the sound emission produced by the air flow.

SUMMARY OF THE INVENTION

It is an object of the present invention to provide an improved way to reduce noise.

An exhaust grille according to the present invention is characterised in that said air flow redirecting members are positioned relative to each other and shaped so that there is substantially no linear air flow path through the passages between said air flow redirecting members irrespective of the direction or angle of incidence of the air flow toward said air flow redirecting members.

It has been found that devices that incorporate a fan, such as a vacuum cleaner, produce sound waves with a high tonal noise (whistle) in the sound spectrum. This whistle is known as the "blade passing frequency" and is determined by the rotational speed of the fan and the number of fan blades. The relationship is shown below in Equation 1.

$$\text{Blade Passing Frequency(Hz)} = \text{Fan Rotation Speed (Hz)} \times \text{Number of Blades} \quad \text{[Equation 1]}$$

Furthermore, sound waves are also produced over a wider (Broadband) frequency. These sound waves may be produced by the flow of exhaust gases over surfaces, turbulence, and the vibrations and structure born sounds from certain structural components for example, in the motor, fan, bearings, exhaust or housing parts.

In some cases, the broadband and specific frequency sound waves travel through the exhaust and exit into the atmosphere. The sound waves emanating from the exhaust can cause annoyance or discomfort to the user.

If the air flow passages are partially non-linear, this means that at least some sound waves may travel directly through them without being incident on the vanes and reflected back, i.e. there is a line of sight through the air flow passages through which some sound waves may pass. If, however, the air flow passages are completely non-linear, then there is no line of sight through the vanes and more of the sound waves are reflected back, as they are incident on the vanes and so prevented from passing through the air flow passages.

It is necessary to strike a balance between maintaining low air flow resistance whilst at the same time increasing the amount of sound waves that are reflected back. It has been found that the grille according to embodiments of the present invention have little or only a negligible effect on the resistance to air flow, but reduces the amount of sound waves that are able to pass through the air flow passages, thereby reducing noise without any appreciable loss of efficiency.

In a preferred embodiment, the air flow redirecting members overlap completely so that there is no linear air flow path between them. This means that there is effectively no "line of sight" through the grille meaning that all the air flow is redirected by the redirecting members. It also means that a much larger proportion of the sound waves are redirected back and cannot pass through the grille, thereby substantially reducing the noise emitted through the grille. Preferably, the air flow redirecting members are positioned and configured so that there is no linear air flow path between them irrespective of the direction or angle of incidence of the air flow relative to the angle of the grille or angle of the air flow redirecting members so that the air flow will always be redirected by the grille no matter what direction the air flow is coming from.

Preferably, each air flow redirecting member is shaped to reflect sound waves in a substantially opposite direction away from said passages. Ideally, the sound waves are redirected in the opposite direction to their direction in which they are travelling towards the grille. However, they may be directed in any direction so long as they are not able to pass through the grille. The air flow redirecting passages may be tortuous or serpentine in shape.

In some embodiments, the exhaust grille may comprise a plurality of vanes and then the air flow redirecting members can comprise at least a part of each a vane. Vanes provide a good way of redirecting air and can be easily formed using a minimum amount of material. However, it is envisaged that the air flow redirecting members could be made from a number of elements, including bars or rods positioned so as to achieve the required aim of allowing air to flow through the grille without substantially increasing its resistance to air flow whilst reducing the amount of sound waves that pass through the grille.

Each vane may have a stepped or curved configuration to define tortuous or serpentine-shaped air flow passages between them. A tortuous passage allows redirected air to flow whilst sound waves are reflected. For example, the vanes could be S-shaped and positioned sufficiently close to each other so that air has to follow a serpentine path between them. As sound waves travel in straight lines and are unable to follow the same path, they will be unable to pass through the grille.

Each vane may have a first and a second portion curved or planar portions. The second portion can extend from the first portion at an angle so that it lies in the air flow path to redirect air and reflect sound waves.

The exhaust grille may have a third portion extending from an opposite end of the second portion to guide air redirected by said second portion. The third portion helps to minimise air flow resistance and directs air away from the grille once it has passed through the passages. The third portion can lie in a plane parallel to a plane in which the first portion lies.

Preferably, the exhaust grille comprises a frame attachable to an opening in a housing of an appliance and array of air redirecting members can then be attached to or integrally formed with said frame. This means that the exhaust grille can be formed as one unitary component for subsequent attachment to the housing of an appliance during assembly.

The air flow redirecting members are preferably configured to reflect sound waves incident thereon in a broadband frequency range.

According to the invention, there is also provided an appliance comprising a housing and an exhaust grille according to the invention, the exhaust grille being attached to the housing. The appliance of the invention may be a vacuum cleaner.

Preferably, the appliance comprises a fan and the exhaust grille is orientated relative to a direction of flow of air from said fan such that sound waves will be reflected back towards the fan and/or the inside of the housing by said air flow redirecting members without passing through said passages. By orientating the exhaust grille, the flow redirecting members can be positioned to ensure that air flow resistance is kept to a minimum whilst as much of the sound waves as possible are reflected.

Preferably, the air flow redirecting members are positioned relative to each other in spaced overlapping relation and are configured such that all the air incident on the grille is diverted by said airflow redirecting members irrespective of the angle of the grille relative to the direction of flow of air towards it.

In a preferred embodiment, an acoustically absorbent material can be positioned in the housing so that sound waves reflected by said redirecting members will be absorbed by said material. This has the advantage that the sound is quickly attenuated within the appliance.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying diagrammatic drawings, in which.

DETAILED DESCRIPTION OF THE EMBODIMENTS

Figure 1:
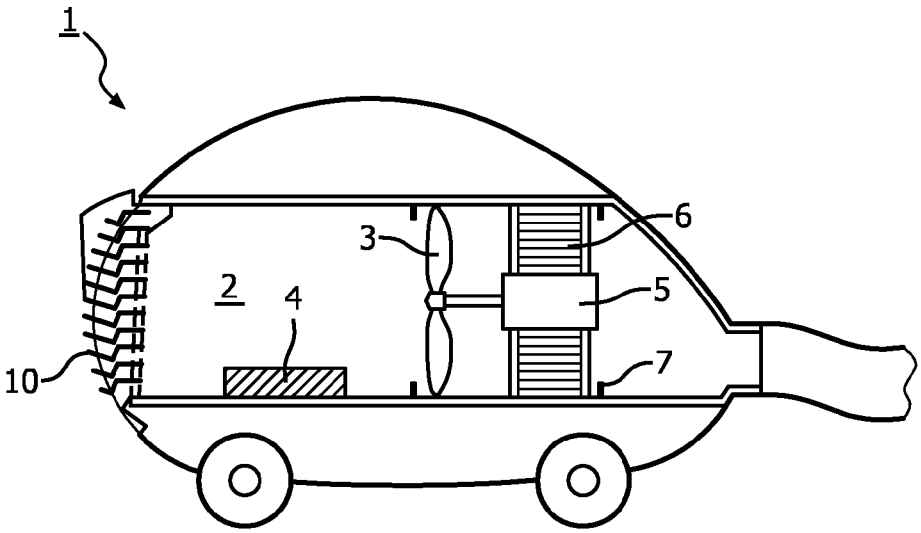
FIG. 1 shows a cross-sectional side view of a vacuum clear including an exhaust grille of a first embodiment of the invention.

Referring now to FIG. 1, a vacuum cleaner 1 having a fan 3 driven by a motor 5, that is contained within a motor pod 7, and an exhaust conduit 2 is shown. The exhaust conduit 2 contains an acoustic sound absorbing material 4 and a filter 6 and is covered by an exhaust grille 10.

Figure 2:
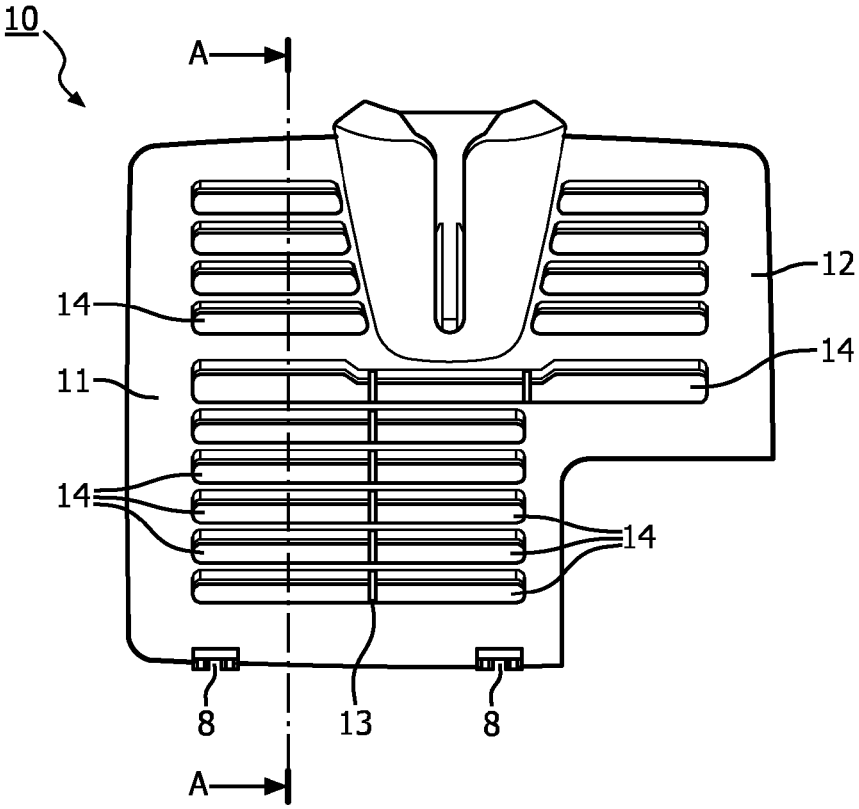
FIG. 2 shows a view of a downstream side of the exhaust grille of FIG. 1.
Figure 3:
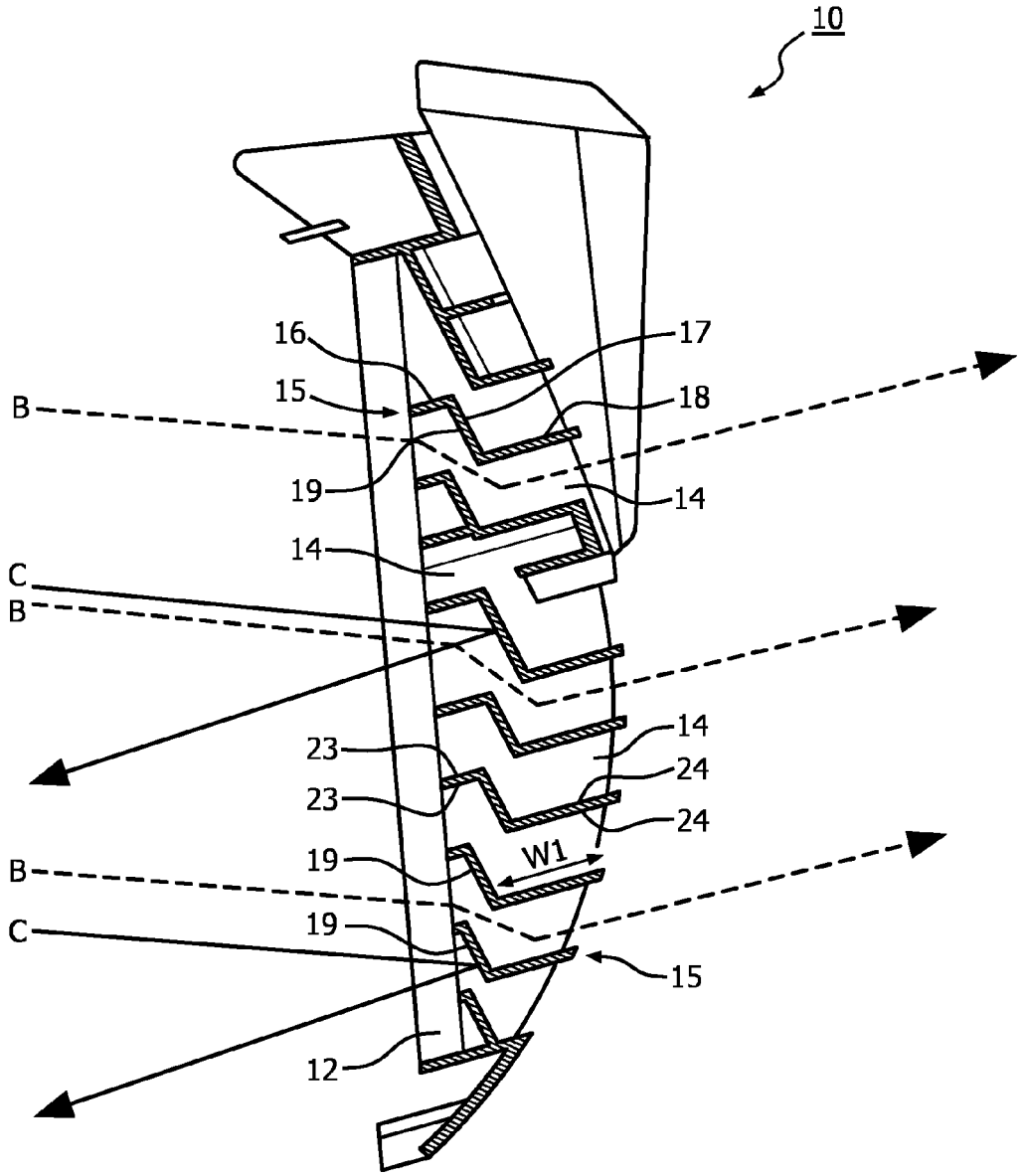
FIG. 3 shows a cross-sectional side view of the exhaust grille of FIGS. 1 and 2 along the line A-A in FIG. 2.

FIGS. 2 and 3 show the exhaust grille 10 of the first embodiment of the present invention in more detail. The grille 10 comprises a frame 11, 12 and a plurality of air flow redirecting members, such as vanes 15, that are surrounded by the frame 11, 12. The frame 11, 12 also includes a support member 13 that extends perpendicular to the vanes 15 and is connected thereto to provide reinforcement for the vanes 15. The grille 10 further comprises a plurality of non-linear air flow passages 14, with a passage 14 being formed between each of adjacent vanes 15. Instead of vanes, alternative air flow redirecting members may be used, such as rods or bars positioned in overlapping spaced relation to each other to form substantially non-linear air flow passages along which sound waves cannot easily travel.

The grille 10 is positioned over the end of the exhaust conduit 2 so that exhaust gas B must travel through the grille 10, via the plurality of passages 14, to vent to atmosphere.

The sound absorbing material 4 is positioned in the exhaust conduit 2 so that sound waves C travelling through the exhaust conduit 2 contact the sound absorbing material 4 and are attenuated. The sound absorbing material 4 may comprise any material that reduces the acoustic energy of sound waves C, for example, porous insulative materials, such as mineral wool or glass wool, micro perforated plates or polymer foam. The composition, density, shape and location of the sound absorbing material 4 may be chosen to be particularly effective at attenuating a specific frequency range, such as the whistle produced by the fan 3, which may be greater than 2000 Hz. The aforementioned properties of the sound absorbing material 4 may also be selected to be particularly effective at attenuating a broadband frequency range.

In the illustrated embodiment, each vane 15 comprises upstream, intermediate and downstream members 16, 17, 18, which generally comprise elongate fin elements. The upstream member 16 of each vane 15 is the nearest part of the vane 15 to the exhaust conduit 2 and the downstream member 18 is spaced from the exhaust conduit 2. Each upstream member 16 is configured so that it has major surface 23 parallel or at an acute angle to the direction of the exhaust gas B in the exhaust 2, so that the incoming exhaust gas B is guided into each passage 14 by the major surfaces 23 on either side of said passage 14.

Each downstream member 18 has major surfaces 24 that are configured to direct the exhaust gas B as it exits the grille 10. The exhaust gas B flowing through a passage 14 will be guided in a direction parallel to the major surfaces 24 of the downstream members 18 on either side of said passage 14. Increasing the width, W1, of each downstream member 18 can enhance its ability to direct the exhaust gas B. In the case of a vacuum cleaner, the exhaust gas B may be directed so that it does not flow directly onto the floor as it exits the grille 10, to prevent the exhaust gas B from blowing dust present on the floor into the air. This can be achieved by positioning the major surfaces 24 of the downstream members 18 so that they are angled upwards with respect to the floor when viewed from upstream of the grille 10.

Each intermediate member 17 connects an upstream and downstream member 16, 18 so that the upstream and downstream members 16, 18 extend from distal ends of the intermediate member 17. Each intermediate member 17 comprises an acoustically reflective surface 19 that is at an angle to incoming exhaust gas B. The reflective surface 19 of each intermediate member 17 forms a kink in an adjacent passage 14 so that the line of sight through said passage 14 is obstructed, and the passage 14 is non-linear or tortuous in shape. Generally, the configuration of the vanes 15 may be such that the air flow passages 14, and also the entrance to the air flow passages 14, are partially occluded.

Each reflective surface 19 is angled so that a large proportion of sound waves C incident upon the grille 10 from the exhaust conduit 2 strike the reflective surface 19 and are reflected back towards the sound absorbing material 4 and are prevented from passing through the grille 10 through the air flow passages 14. In this manner, the sound waves C may be subjected to the attenuating properties of the sound absorbing material 4 multiple times: when they initially travel down the exhaust conduit 2 towards the exhaust grille 10 and then each subsequent time after when they are reflected from a surface, for example, the reflective surface 19 or a wall of the exhaust 2, and come back into contact with the sound absorbing material 4. Therefore, the attenuation of the sound waves C is increased and the noise level that emanates into the atmosphere from the exhaust conduit 2 is reduced. The reflective surfaces 19 may be positioned to reflect the sound waves C in a desired direction by angling the reflective surfaces 19 with respect to the grille side members 11, 12, which then are positioned perpendicularly to the direction of the flow of the exhaust gas B. The reflective surfaces 19 may also be positioned to reflect the sound waves C in a desired direction by angling the entire grille 10 with respect to the direction of the flow of the exhaust gas B.

The upstream, intermediate and downstream members 16, 17, 18 are each configured so that the flow of exhaust gas B through each passage 14 is restricted as little as possible whilst still providing the above-described sound reflective properties, and so each passage 14 has a relatively low flow resistance. A low flow resistance through the passages 14 may maintain the flow rate of the exhaust gas B and, therefore, provide a better fan 3 performance than exhaust grilles that have a higher flow resistance. In the case of a vacuum cleaner 2, a reduced exhaust grille 10 flow resistance may result in an improved suction performance. Furthermore, a smooth exhaust gas B flow through each passage 14 may reduce the noise produced by the exhaust gas B as it flows through the passage 14 by preventing rapid flow fluctuations and/or promoting a laminar flow regime, so that the exhaust grille 10 does not generate a significant amount of additional noise. In one embodiment (not shown), the interfaces between the upstream, intermediate and downstream members 16, 17, 18 have rounded edges to promote a smooth flow of exhaust gas B through the passages 14.

The intermediate member 17 is configured so that it acts as an "acoustically hard wall", being stiff to increase the reflection of sound waves C from the reflective surface 19 rather than allowing all of the sound waves C to pass through the intermediate member 17 where the sound waves C would then be able to escape to atmosphere. This can be achieved by increasing the thickness of the intermediate member 17 and/or manufacturing the intermediate member 17 from an "acoustically hard" material that has good acoustically reflective properties, for example, plastic or metal. In one embodiment, the intermediate member 17 may have a coating that improves the acoustic reflecting properties of the reflective surface 19.

The exhaust grille 10 may be manufactured from a durable material, for example, plastic or metal, which is durable enough to protect the components inside the exhaust conduit 2 from wear. The configuration of the vanes 15 which partially occlude the passages 14, and/or reduce the line of sight through the passages 14, of the exhaust grille 10 may help to reduce damage to components in the exhaust 2, for example, a HEPA filter or blades of the fan 3. The exhaust grille 10 may perform a combined function of reflecting sound waves C in the exhaust 2, to reduce noise emanating from the exhaust 2, and protecting the components inside the exhaust 2, and, therefore, the exhaust grille 10 may save space and/or manufacturing materials over a system that uses separate means to protect components and reduce noise levels. In cases where the exhaust grille 10 is positioned over the end of the exhaust 2, the exhaust grille 10 may provide the last feature of the appliance to reflect sound waves C back in to the exhaust conduit 2 before they escape to atmosphere.

The exhaust grille 10 comprises hinges 8 so that it may be pivotally connected to the exhaust 2. In alternate embodiments (not shown), the exhaust grille 10 may be integrally formed with the exhaust conduit 2 or connected thereto by an appropriate known fastening means, for example, adhesive or screws. A removable or hingedly connected grille 10 may allow ease of access to the inside of the exhaust conduit 2 for cleaning purposes and/or to replace components, for example, the sound absorbent material 4, filter 6, or exhaust grille 10.

Figure 4:
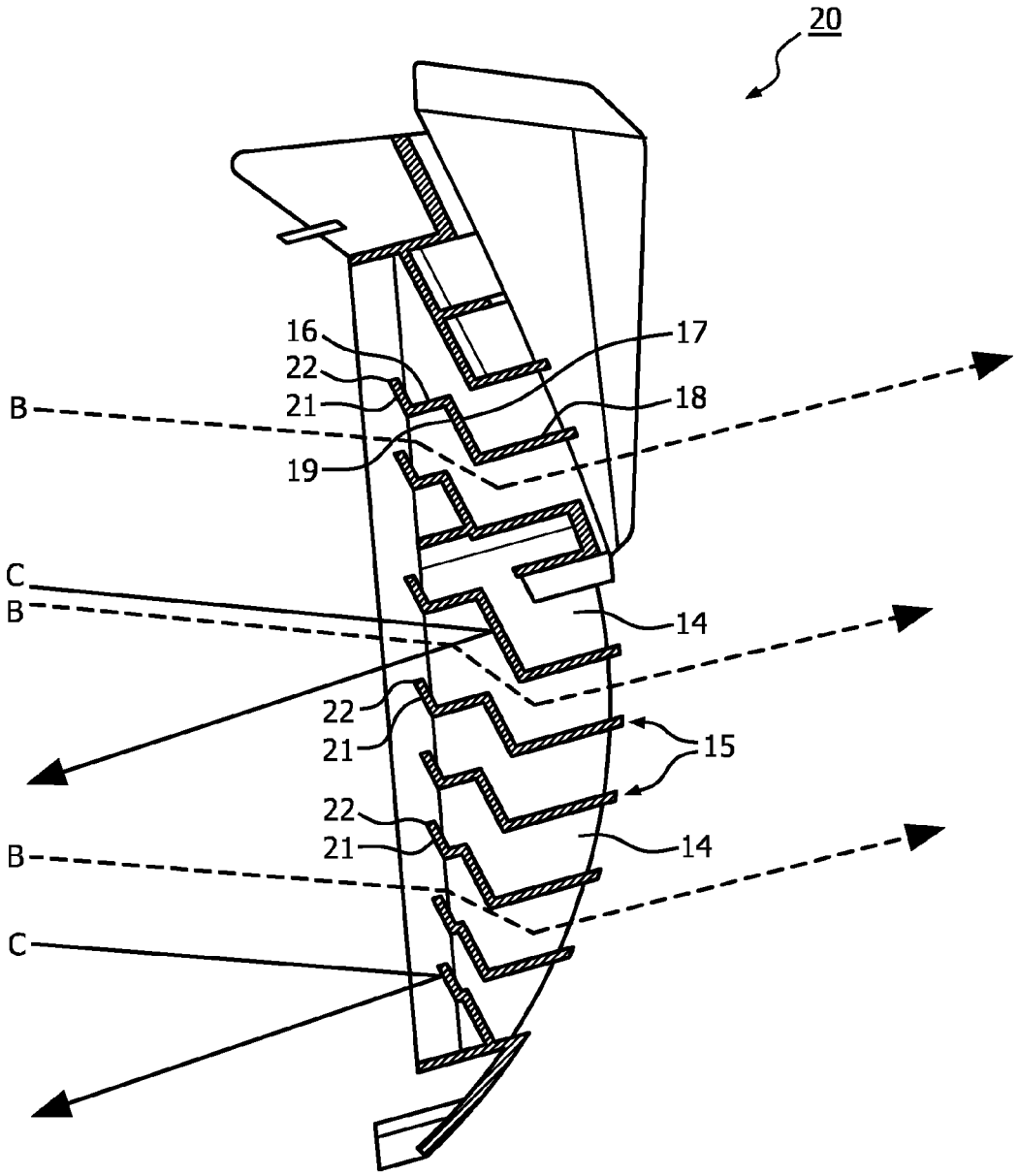
FIG. 4 shows a cross-sectional side view of an exhaust grille of a second embodiment of the invention.

An exhaust grille 20 according to a second embodiment is shown in FIG. 4. As with the first embodiment, the grille 20 comprises a plurality of vanes 15 with a plurality of passages 14 formed therebetween. The difference between the first and second embodiments is that the each of the vanes 15 further comprises a leading member 21 that is connected to the upstream member 17 and has a second acoustically reflective surface or baffle 22. As with the first reflective surfaces 19 describe previously, the second reflective surfaces 22 are also angled, with respect to the flow of the exhaust gas B, so that sound waves C strike the second reflective surfaces 22 and are reflected towards the acoustical absorption material 4. In this manner, the sound waves C are subjected to the attenuating properties of the acoustical absorption material 4 multiple times, when they initially travel down the exhaust conduit 2 towards the exhaust grille 10 and then each subsequent time after when they are reflected from a surface, for example, the reflective surface 22 or a wall of the exhaust 2, and come back into contact with the acoustical absorption material 4. The second reflective surfaces 22 may increase the overall surface area of the exhaust grille 10 that reflects sound waves C towards the acoustical absorption material 4, and, therefore, may reduce the noise level that emanates from the exhaust conduit 2 and into the atmosphere. Furthermore, the increased area of the total reflective surface of each vane 15 may allow for each vane 15 to be positioned further apart to achieve the same amount of sound wave C reflection, and, therefore, may reduce the total number of vanes 15 required and/or allow for a reduced air flow resistance through each passage 14 as the cross-sectional areal of each passage 14 is larger.

Adjacent first reflective surfaces 19 and/or second reflective surfaces 22 may be configured to overlap, when viewed in the direction of the flow of the exhaust gas B, to increase the total surface of the exhaust grille 10, 20 available to reflect sound waves C, and, therefore, increase the reflection of sound waves C, reduce the total number of vanes 15 required and/or allow for the spacing between adjacent vanes 15 to be increased.

Figure 5:
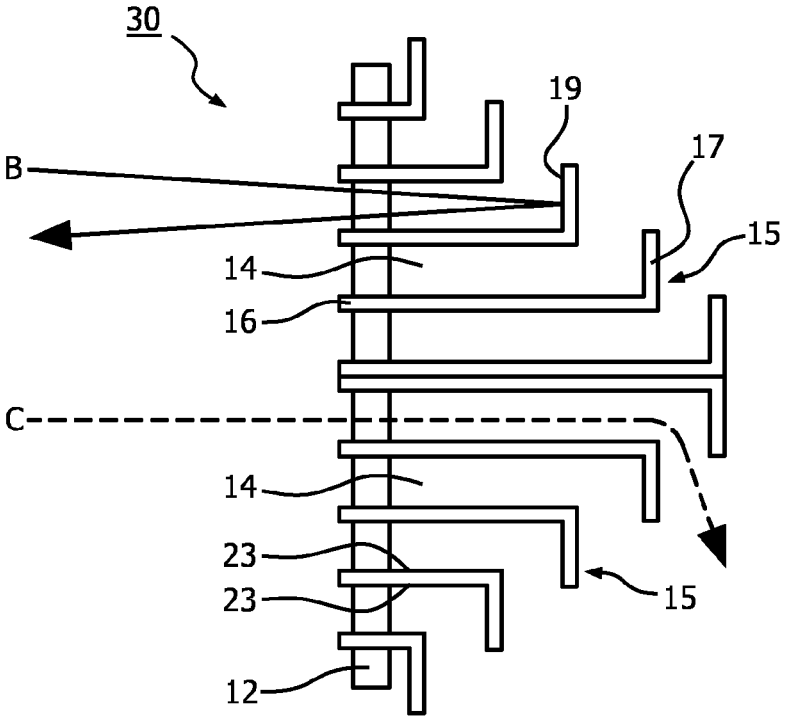
FIG. 5 shows a cross-sectional side view of an exhaust grille of a third embodiment of the invention.

An exhaust grille 30 according to a third embodiment is shown in FIG. 5. As with the first embodiment, the grille 30 comprises a plurality of vanes 15 with a plurality of passages 14 formed therebetween. A difference between the first and third embodiments is that the downstream member of each vane 15 is omitted. As with the first embodiment of the invention, each vane 15 comprises an upstream member 16 that has major surfaces 23 that are parallel or at an acute angle to the direction of the exhaust gas B, so that the incoming exhaust gas B is guided into each passage 14 by the major surfaces 23 on either side of said passage 14.

Each vane 15 further comprises an intermediate member 17 that is connected to the upstream member 16 of said vane 15 and has an acoustically reflective surface 19 that is at an angle to incoming exhaust gas B. The reflective surface 19 of each intermediate member 17 forms a kink in an adjacent passage 14 so that the line of sight through said passage 14 is obstructed.

Each reflective surface 19 is angled so that sound waves C that enter the passage 14 and strike the reflective surface 19 are reflected back out of the passage towards the acoustical absorption material 4.

Figure 6:
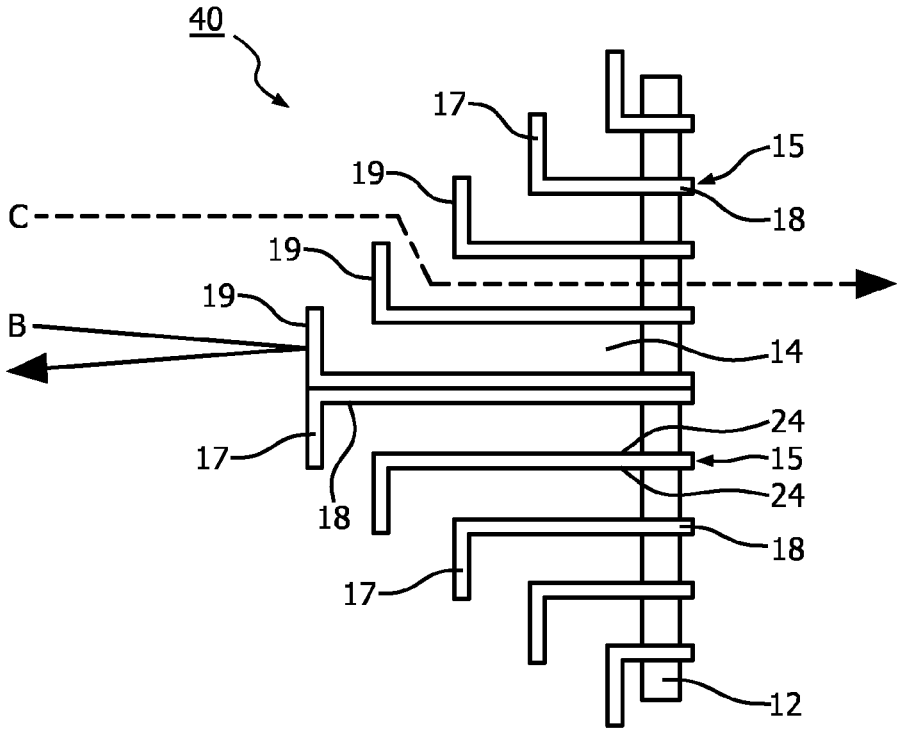
FIG. 6 shows a cross-sectional side view of an exhaust grille of a fourth embodiment of the invention.

An exhaust grille 40 according to a fourth embodiment is shown in FIG. 6. As with the first embodiment, the grille 40 comprises a plurality of vanes 15 with a plurality of passages 14 formed therebetween. A difference between the first and fourth embodiments is that the upstream member of each vane 15 is omitted. As with the first embodiment of the invention, each vane 15 comprises a downstream member 18 that has major surfaces 24 which are configured to direct the exhaust gas B as it exits the grille 10. The exhaust gas B flowing through a passage 14 will be guided in a direction parallel to the major surfaces 24 of the downstream members 18 on either side of said passage 14.

Each vane 15 further comprises an intermediate member 17 that is connected to the downstream member 18 of said vane 15 and has an acoustically reflective surface 19 that is at an angle to incoming exhaust gas B. The reflective surface 19 of each intermediate member 17 forms a kink in an adjacent passage 14 so that the line of sight through said passage 14 is obstructed.

Each reflective surface 19 is angled so that sound waves C that enter the passage 14 and strike the reflective surface 19 are reflected back out of the passage towards the acoustical absorption material 4.

It will be appreciated that the grilles of embodiments of the invention described above generally comprise vanes defining air flow passages therebetween, and which are also configured such that portions of the vanes include one or more surfaces or baffles to reflect sound waves incident upon the grille away from the grille and to prevent such sound waves from passing through the grill, through the passages. It may be preferable that a portion of the vanes, such as a baffle portion, is oriented at an angle of less than 45 degrees from the plane of the grille frame to achieve desire sound wave reflection.

In the above described embodiments the upstream, intermediate, downstream and/or leading members 16, 17, 18, 20 are integrally formed to comprise each vane 15. However, in an alternate embodiment, the upstream, intermediate, downstream and/or leading members 16, 17, 18, 20 may be connected to each other by adhesive or screws. In one embodiment (not shown), the exhaust grille 10, 20, 30, 40 is formed from a plate of material, with sections cut or milled out of the plate of material to form the passages 14, with the remaining areas of material in between the passages 14 forming the vanes 15. In another embodiment, the exhaust grille 10, 20, 30, 40 may be formed from a wall of the exhaust 2. This embodiment may reduce the amount of components required and so may be simpler and/or less expensive to manufacture.

Although in the above described embodiments the acoustical absorption material 4 is positioned in the exhaust 2, in an alternate embodiment (not shown) the acoustical absorption material 4 may instead be positioned in the motor pod 7. The reflective surfaces 19, 22 are then configured to reflect the sound waves C into the motor pod 7 to be attenuated by the acoustical absorption material 4. In a further embodiment (not shown), the exhaust conduit 2 and motor pod 7 both contain acoustical absorption material 4.

Although in the above described embodiments the acoustical absorption material 4 is positioned in the exhaust conduit 2 or motor pod 7 to attenuate the sound waves C, in an alternate embodiment (not shown) the separate acoustical absorption material 4 is omitted and instead the exhaust conduit 2 and/or motor pod 7 is manufactured from an acoustical absorption material 4. In yet another embodiment (not shown), the acoustical absorption material 4 is omitted entirely, and instead the reflective surface(s) 19, 22 are configured to reflect the sound waves C back into the exhaust conduit 2 and/or motor pod 7. This embodiment may be simpler less expensive to manufacture and may still reduce the noise emanating from the vacuum cleaner 1, as sound waves C will still be attenuated as they travel through the exhaust gas and/or are reflected from internal surfaces of the vacuum cleaner 1, such as, surfaces of the exhaust 2, motor 5 and motor pod 7.

Although in the above described embodiment the line of sight through each passage 14, when viewed in the direction of the gas flow B, is completely obscured, in an alternate embodiment (not shown) the line of sight through each passage 14 may be only partially obscured. In such an alternative embodiment, a proportion of the sound waves C may be able to pass through the passage, and, therefore, emanate from the exhaust 2. However, the remaining proportion of sound waves C will still be reflected back into the exhaust conduit 2 by the reflective surfaces 19, 22, and so the overall noise level emanating from the exhaust conduit 2 will still be lower than if the exhaust grille 10, 20, 30, 40 was not implemented.

Although in the above described embodiments the exhaust grille 10, 20, 30, 40 is described for use with a vacuum cleaner 1, it should be recognised that the exhaust grille 10, 20, 30, 40 may also be used with other mechanical devices that have an exhaust fluid flow, for example, tumble dryers, hand/hair dryers, cooling systems and combustion engines.

Although in the above described embodiments the vanes 15 extend between the side members 11, 12 of the grille 10, 20, 30, 40, in alternate embodiments (not shown) the vanes 15 may extend between a top and bottom of the grille 10, 20, 30, 40. In this embodiment the downstream members 18 would be able to direct the exhaust gas in a direction relative to the side members 11, 12.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. An exhaust grille comprising:

an array of air flow redirecting members positioned relative to each other in spaced overlapping relation, said air flow redirecting members defining a non-linear passages between adjacent ones of the redirecting members, wherein substantially all the air incident on said grille is diverted by said air flow redirecting members through said passages to exit said grille, and sound waves are reflected by said air flow redirecting members to prevent the sound waves from passing through said passages, wherein said overlapping relation causes an output of a selected passage to align with an input of an adjacent passage.

2. The exhaust grille according to claim 1, wherein said air flow redirecting members are shaped so that the passages are serpentine in shape.

3. The exhaust grille according to claim 2, comprising a plurality of vanes, the air flow redirecting members comprising at least a part of each vane.

4. The exhaust grille according to claim 3, wherein each vane has one of: a stepped or curved configuration to define said air flow passages.

5. The exhaust grille according to claim 4, wherein each vane comprises a first portion and a second portion, the second portion extending from the first portion at an angle so that the second portion lies in the air flow path to redirect air and reflect sound waves.

6. The exhaust grille according to claim 5, wherein a third portion extends from an opposite end of the second portion to guide air redirected by said second portion.

7. The exhaust grille according to claim 6, wherein the third portion lies in a plane parallel to a plane in which the first portion lies.

8. An exhaust grille according to claim 1 comprising:

a frame for attachment to an opening in a housing of an appliance, the array of air redirecting members being attached to or integrally formed with said frame.

9. The appliance comprising:

a housing, and an exhaust grille mounted to the housing, said exhaust grille comprising:

an array of air flow redirecting members positioned relative to each other in spaced overlapped relation, said air flow redirecting members defining a non-linear passage between adjacent ones of the redirecting members, wherein substantially all the air incident on said grille is diverted by said air flow redirecting members through said passages to exit said grille, and sound waves are reflected by said air flow redirecting members to prevent the sound waves from passing through said passages, wherein said overlapping relation causes an output of a selected passage to align with an input of an adjacent passage.

10. The appliance according to claim 8, comprising acoustically absorbent material in the housing, the acoustically absorbent material positioned so that sound waves reflected by said vanes are absorbed by said material.

11. A vacuum cleaner comprising:

a housing comprising;

an input port;

an output port, and a motor drawing air through the input port to the output port; and an exhaust grille mounted to the output port of the housing, said exhaust grille comprising:

an array of air flow redirecting members positioned relative to each other in spaced overlapping relation, said air flow redirecting members defining a non-linear passage between adjacent ones of the redirecting members, wherein substantially all the air incident on said grille is diverted by said air flow redirecting members through said passages to exit said grille and sound waves are reflected by said air flow redirecting members to prevent the sound waves from passing through said passages, wherein said overlapping relation causes an output of a selected passage to align with an input of an adjacent passage.

* * * * *